US012427358B2

(12) United States Patent
Ciccarone

(10) Patent No.: US 12,427,358 B2
(45) Date of Patent: Sep. 30, 2025

(54) MULTI-PIECE END CAP SYSTEM FOR WRAPPABLE SPORT WEIGHT

(71) Applicant: LACEUP FITNESS LLC, Montgomeryville, PA (US)

(72) Inventor: Jay Ciccarone, Wayne, PA (US)

(73) Assignee: LACEUP FITNESS LLC, Montgomeryville, PA (US)

( * ) Notice: Subject to any disclaimer, the term of this patent is extended or adjusted under 35 U.S.C. 154(b) by 36 days.

(21) Appl. No.: 18/189,509

(22) Filed: Mar. 24, 2023

(65) Prior Publication Data

US 2024/0316387 A1 Sep. 26, 2024

(51) Int. Cl.
*A63B 21/065* (2006.01)
*A63B 21/06* (2006.01)
*A63B 71/00* (2006.01)

(52) U.S. Cl.
CPC ..... *A63B 21/065* (2013.01); *A63B 21/0607* (2013.01); *A63B 71/0036* (2013.01)

(58) Field of Classification Search
CPC ..... A63B 21/065; A63B 71/0036; A63B 21/0601–0607; A63B 21/06–08
See application file for complete search history.

(56) References Cited

U.S. PATENT DOCUMENTS 2,509,810 A * 5/1950 Core, Jr. ..... A63B 15/00 241/179
3,006,646 A * 10/1961 Menotti ..... A63B 21/0624 482/109
3,145,963 A 8/1964 Best
3,578,223 A * 5/1971 Armour ..... B65D 47/242 222/521
3,827,689 A 8/1974 Hyde
4,157,827 A * 6/1979 Winston ..... A63B 23/16 482/93
4,192,502 A 3/1980 Owen
4,369,967 A 1/1983 Kimura
D279,250 S 6/1985 Holloway
4,623,143 A 11/1986 Wuellenweber
4,742,655 A 5/1988 Kovasna
D304,057 S 10/1989 Cooper
(Continued)

FOREIGN PATENT DOCUMENTS

CN 202682708 U 1/2013
EM 008648489-0001 8/2021
(Continued)

OTHER PUBLICATIONS

International Search Report and Written Opinion for PCT/US24/21187 filed Mar. 22, 2024, completed Jun. 9, 2024, mailed Jul. 25, 2024, 16 pages.
(Continued)

*Primary Examiner* — Nyca T Nguyen
(74) *Attorney, Agent, or Firm* — Brooks Kushman P.C.

(57) ABSTRACT

A multi end cap system for a wrappable sport weight has an inner cap including a hat defining a rim configured to rest on an end of a compressible covering of the wrappable sport weight, and a sleeve extending away from the rim and configured to be inserted between the compressible covering and a flexible bar of the wrappable sport weight to displace a portion of the compressible covering away from the flexible bar.

11 Claims, 5 Drawing Sheets

(56) References Cited

U.S. PATENT DOCUMENTS

| | | | | |
|---|---|---|---|---|
| 5,072,935 | A | 12/1991 | McWain | |
| 5,316,531 | A | 5/1994 | Spence | |
| 5,700,229 | A | 12/1997 | Kamofsky | |
| D389,038 | S | 1/1998 | Rosul | |
| 5,978,964 | A | 11/1999 | Gaston | |
| 5,980,397 | A | 11/1999 | Hart et al. | |
| D422,884 | S | 4/2000 | Lafond | |
| 6,241,623 | B1 * | 6/2001 | Laibangyang | A63B 53/14 473/238 |
| 6,379,286 | B1 | 4/2002 | Scopino et al. | |
| 6,394,909 | B1 * | 5/2002 | Laibangyang | A63B 53/10 473/238 |
| D476,046 | S | 6/2003 | Wang et al. | |
| 7,383,588 | B2 | 6/2008 | Victor | |
| D582,994 | S | 12/2008 | Ulichney et al. | |
| D582,995 | S | 12/2008 | Ulichney et al. | |
| 7,481,716 | B1 * | 1/2009 | Johnson | A63B 60/24 473/297 |
| 7,704,198 | B2 | 4/2010 | Brown, Jr. | |
| 7,841,972 | B1 | 11/2010 | Huang et al. | |
| 8,038,585 | B1 | 10/2011 | Brown | |
| 8,231,510 | B2 | 7/2012 | Abdo | |
| D672,227 | S | 12/2012 | Hendricks | |
| D672,228 | S | 12/2012 | Hendricks | |
| D687,291 | S | 8/2013 | Hendricks | |
| D694,348 | S | 11/2013 | Rankin | |
| D698,658 | S | 2/2014 | Leask | |
| D699,556 | S | 2/2014 | Hendricks | |
| 8,821,356 | B2 | 9/2014 | Burke | |
| D733,226 | S | 6/2015 | Abbate | |
| 9,044,642 | B2 | 6/2015 | Mikulski | |
| 9,314,660 | B1 | 4/2016 | Welch | |
| D779,598 | S | 2/2017 | Corley | |
| 9,795,197 | B2 | 10/2017 | Rizzuto | |
| D842,940 | S | 3/2019 | Harden | |
| D894,416 | S | 8/2020 | French | |
| 11,038,925 | B2 | 6/2021 | Brannon et al. | |
| 11,110,314 | B1 * | 9/2021 | Wineman | A63B 23/1209 |
| D941,127 | S | 1/2022 | Sutliff, II | |
| D949,112 | S | 4/2022 | Wedding | |
| D984,879 | S | 5/2023 | Mei | |
| 11,648,449 | B1 * | 5/2023 | Pfeifer | A63B 60/16 473/513 |
| 2002/0134850 | A1 | 9/2002 | Hollenberg | |
| 2003/0130070 | A1 | 7/2003 | Nolan | |
| 2004/0259666 | A1 | 12/2004 | Bjugstad et al. | |
| 2007/0049135 | A1 * | 3/2007 | Allen | A63B 21/0603 439/894 |
| 2007/0207903 | A1 | 9/2007 | Csabai | |
| 2008/0108457 | A1 | 5/2008 | Hansen et al. | |
| 2008/0237080 | A1 | 10/2008 | Andrews | |
| 2009/0205106 | A1 | 8/2009 | Sohn | |
| 2010/0064413 | A1 | 3/2010 | Koelle et al. | |
| 2010/0216613 | A1 | 8/2010 | Pacini | |
| 2010/0323858 | A1 | 12/2010 | Yang | |
| 2011/0275458 | A1 | 11/2011 | Estrada, Jr. et al. | |
| 2012/0245000 | A1 | 9/2012 | Burke | |
| 2013/0012342 | A1 | 1/2013 | Rotanz | |
| 2013/0296145 | A1 | 11/2013 | Tomaszewski | |
| 2014/0113777 | A1 | 4/2014 | Pahl | |
| 2014/0121075 | A1 | 5/2014 | Brown | |
| 2014/0190623 | A1 | 7/2014 | Bradford et al. | |
| 2016/0082342 | A1 | 3/2016 | Brown et al. | |
| 2017/0021223 | A1 | 1/2017 | Ramsey et al. | |
| 2017/0073514 | A1 | 3/2017 | Kurup | |
| 2018/0221738 | A1 | 8/2018 | Panozzo | |
| 2018/0256934 | A1 * | 9/2018 | Ciccarone | A63B 21/0601 |
| 2018/0256935 | A1 * | 9/2018 | Ciccarone | A63B 1/00 |
| 2019/0235217 | A1 * | 8/2019 | Hasegawa | G02B 7/02 |
| 2020/0107661 | A1 | 4/2020 | Lin | |
| 2020/0171336 | A1 * | 6/2020 | Brown, Jr. | A63B 23/03508 |
| 2020/0338411 | A1 * | 10/2020 | Nakamura | B29C 70/766 |
| 2020/0338415 | A1 * | 10/2020 | Takasu | A63B 60/42 |
| 2021/0361995 | A1 | 11/2021 | Ciccarone et al. | |
| 2022/0168602 | A1 * | 6/2022 | Lee | A62C 35/10 |
| 2022/0296952 | A1 * | 9/2022 | Masotta | A63B 21/0004 |
| 2023/0211214 | A1 * | 7/2023 | Olson | A63B 53/12 473/316 |

FOREIGN PATENT DOCUMENTS

| | | | |
|---|---|---|---|
| EM | 008648489-0002 | | 8/2021 |
| EM | 008648489-0003 | | 8/2021 |
| EM | 008648489-0004 | | 8/2021 |
| EM | 008648489-0005 | | 8/2021 |
| EM | 008648489-0006 | | 8/2021 |
| EP | 1832184 | A1 | 9/2007 |
| GB | 1568081 | | 5/1980 |
| GB | 2222092 | B | 7/1992 |
| GB | 2293116 | A | 3/1996 |
| JP | 2007044316 | A | 2/2007 |
| KR | 20240007432 | A * | 1/2024 |
| WO | 8501219 | A1 | 3/1985 |

OTHER PUBLICATIONS

LaceUp Wrist Weights, available on laceup.com, Wayback Machine date Apr. 12, 2019, [site visited Jul. 14, 2023], URL: https://web.archive.org/web/20190412223605/https://laceup.com/ (Year: 2010).

Laceup Athletics, "5 Oz., 8 Oz., & 12 Oz. Training Lace 3-Pack (Baseball)" 2018, 4 pages.

Lace N Loop Straps, available on Amazon.com, date first available Jun. 15, 2018, site visited Feb. 6, 2023, URL: https://www.amazon.com/Lace-Loop-Straps-Pair-Converter/dp/B07YP2KW3Q?th=1, 3 pages.

Training LaceUp, available on Facebook.com, date posted Aug. 12, 2017, [site visited Feb. 6, 2023], URL: https://www.facebook.com/TrainingLace/photos/pb.100059036357964.-2207520000./1923877434522416/?type=3 (Year: 2017).

Training Lace Article, available on vista.today, published Mar. 23, 2018, [site visited Feb. 6, 2023], URL: https://vista.today/2018/03/wayne-company-introduces-perhaps-the-only-training-aid-on-the-market-for-all-sports/# (Year: 2018).

LaceUp Fitness Weight, available on Amazon.com, date first available Nov. 19, 2020, oldest customer review with photo Dec. 30, 2020, [site visited Feb. 6, 2023], URL: https://www.amazon.com/Training-Lace-Wearable-Exercise-Aerobics/dp/B08NZG2Z29/ (Year: 2020).

LaceUp Weight, available on laceup.com, Wayback Machine date Sep. 20, 2008, [site visited Feb. 6, 2023], URL: https://web.archive.org/web/20080920103303/https://www.laceup.com/ (Year: 2008).

Vaupan Weights, available on Amazon.com, date first available Dec. 23, 2019, [site visited Feb. 6, 2023], URL: https://www.amazon.com/Vaupan-Exercise-Equipment-Adjustable-Gymnastics/dp/B0831Q8C4Z/ (Year: 2019).

LaceUp Wrist Weights, available on laceup.com, Wayback Machine date Mar. 13, 2006, [site visited Feb. 6, 2023], URL: https://web.archive.org/web/20060313201138/https://www.laceup.com/ (Year: 2006).

https://www.livestrong.com/article/493618-diabetics-hand-tremors/, Archived Dec. 9, 2016, Retrieved Jun. 14, 2018, 2 pages.

https://www.thomassci.com/Laboratory-Supplies/Lead-Rings/_/VINYL-COATED-LEAD-WIRE-AND-SHEETS, Archived Aug. 7, 2016, Retrieved Jun. 18, 2018, 1 page.

"Training Lace", LaceUp Athletics, Training Lace, Oct. 11, 2017, web.archive.org/web/20171011232259/https://traininglace.com, 12 pages.

Laceup Athletics, "Training Lace Athletic Weights", 2019, 2 pages.

* cited by examiner

MULTI-PIECE END CAP SYSTEM FOR WRAPPABLE SPORT WEIGHT

TECHNICAL FIELD

This disclosure relates to sporting equipment.

BACKGROUND

Weights may facilitate resistance training. Such weights may be held for example while repetitive movements are performed.

SUMMARY

A multi end cap system for a wrappable sport weight has an inner cap including a hat defining a rim configured to rest on an end of a compressible covering of the wrappable sport weight, and a sleeve extending away from the rim and configured to be inserted between the compressible covering and a flexible bar of the wrappable sport weight to displace a portion of the compressible covering away from the flexible bar. The inner cap defines an inner cavity configured to receive an end of the flexible bar. The multi end cap system also has an outer cap defining an outer cavity. The inner cap is disposed within the outer cavity such that the hat is surrounded by and in contact with the outer cap. The outer cap includes a tube portion configured to engage a ledge of the wrappable sport weight partially defined by the end such that the portion is compressed between the sleeve and tube portion.

A multi end cap system for a wrappable sport weight has an inner cap including a hat defining a rim configured to rest on an end of a compressible covering of the wrappable sport weight, and a sleeve extending away from the rim and configured to be inserted between the compressible covering and a pair of flexible bars of the wrappable sport weight to displace a portion of the compressible covering away from the flexible bars. The inner cap defines a binocular-shaped inner cavity configured to receive ends of the flexible bars. The multi end cap system further has an outer cap defining an outer cavity. The inner cap is disposed within the outer cavity such that the hat is surrounded by and in contact with the outer cap. The outer cap includes a tube portion configured to engage a ledge of the wrappable sport weight partially defined by the end such that the portion is compressed between the sleeve and tube portion.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1A:
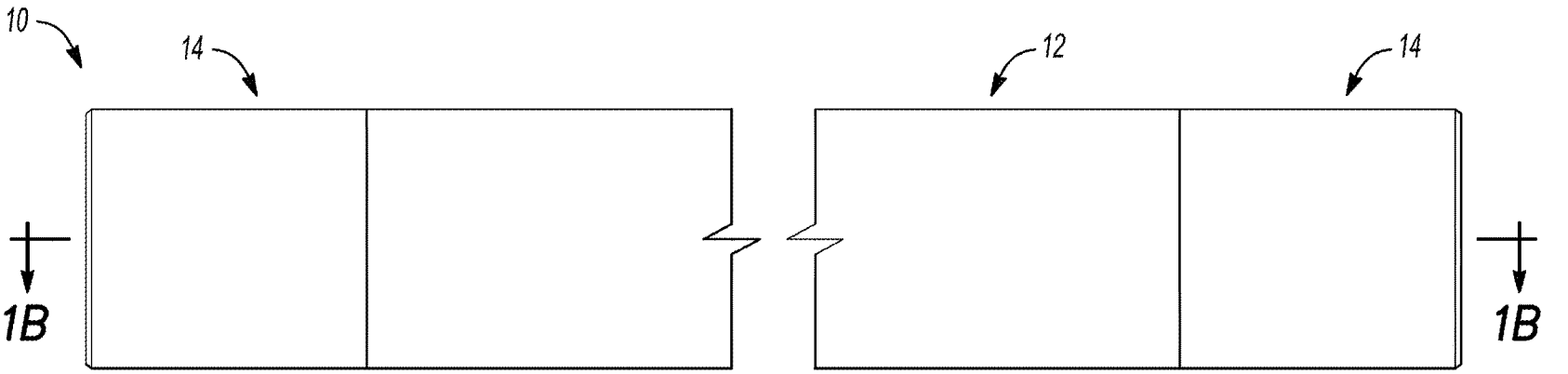
FIG. 1A is a top view of a wrappable sport weight.
Figure 1B:
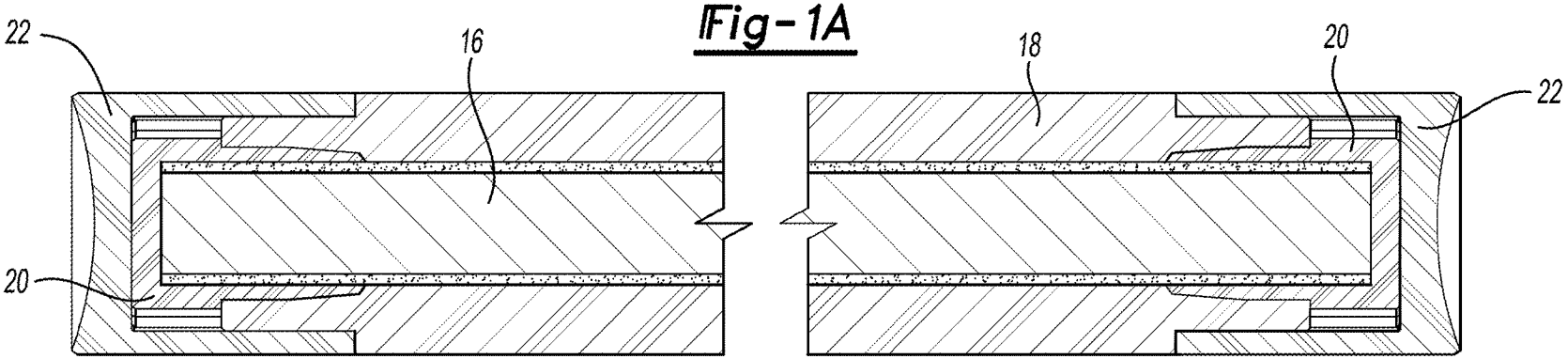
FIG. 1B is a top view, in cross-section, of the wrappable sport weight of FIG. 1A.
Figure 1C:
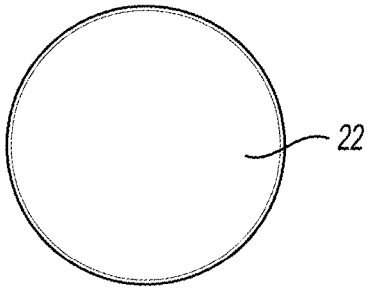
FIG. 1C is an end view of the wrappable sport weight of FIG. 1A.

Referring to FIGS. 1A, 1B, and 1C, a wrappable sport weight 10 includes a body 12 and a pair of end cap arrangements 14. The body 12 includes a flexible bar 16 (e.g., a coated lead bar) and a compressible covering 18 (e.g., a foam covering) surrounding the flexible bar 16. As such, the body 12 may be wrapped around an appendage or sporting equipment (e.g., a baseball bat, a lacrosse stick, etc.) while repetitive movements are performed. The end cap arrangements 14 each include an inner cap 20 and an outer cap 22. As discussed in more detail below, the inner cap 20 is nested within the outer cap 22.

Figure 2:
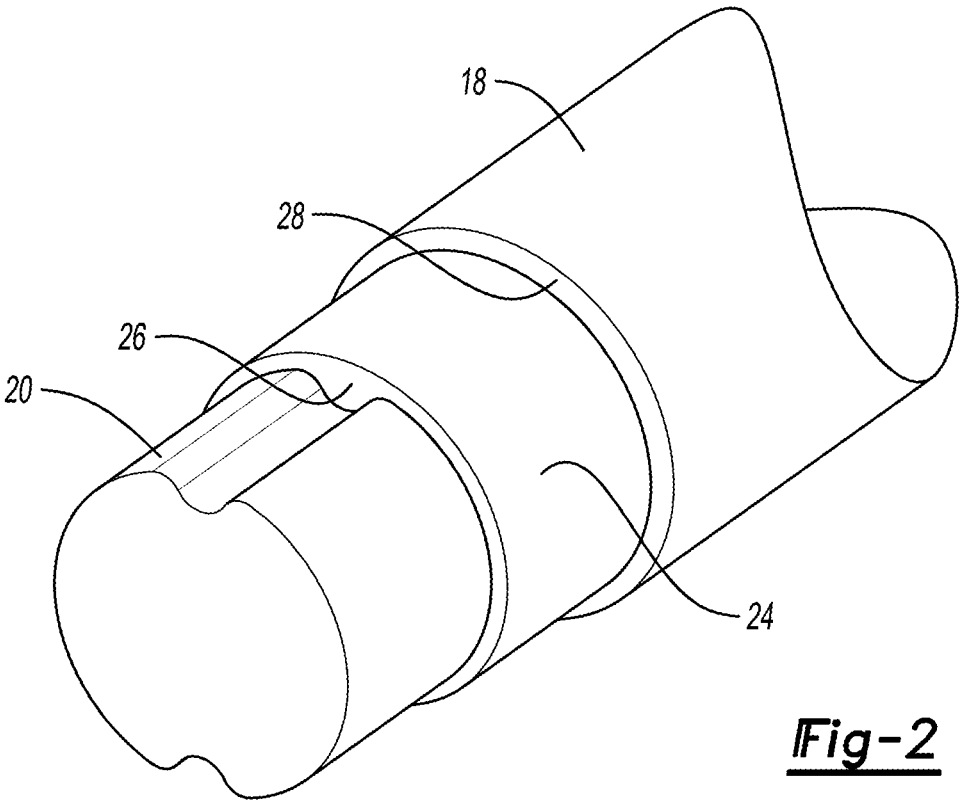
FIG. 2 is a perspective view of an end of the wrappable sport weight of FIG. 1A absent its outer end cap.

Referring to FIG. 2, the compressible covering 18, near ends of the body 12, has a thinner region that defines a ledge 24 with an edge 26 and a lip 28. The edge 26 defines the end of the compressible covering 18 and the lip 28 defines that region between the thicker portion of the compressible covering 18 and the ledge 24 (i.e., the thinner portion of the compressible covering 18). As discussed in more detail below, the outer cap 22 slides over the ledge 24 and rests against the lip 28.

Figure 3:
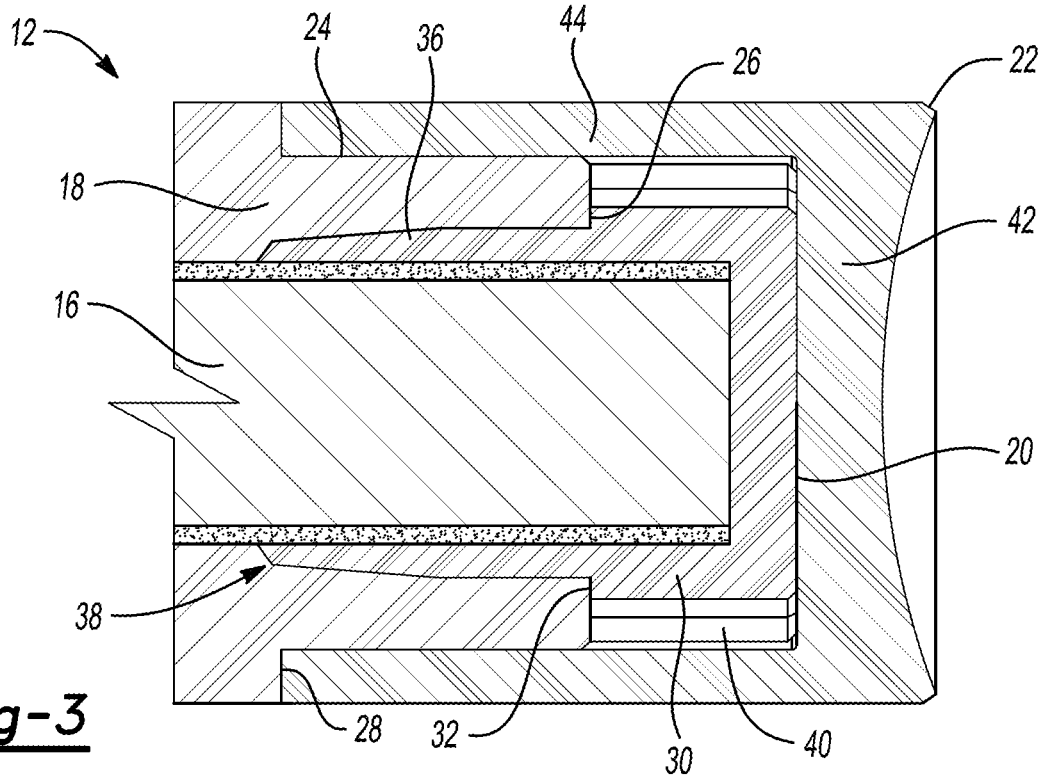
FIG. 3 is a top view, in cross-section, of an end of the wrappable sport weight of FIG. 1B.
Figure 4A:
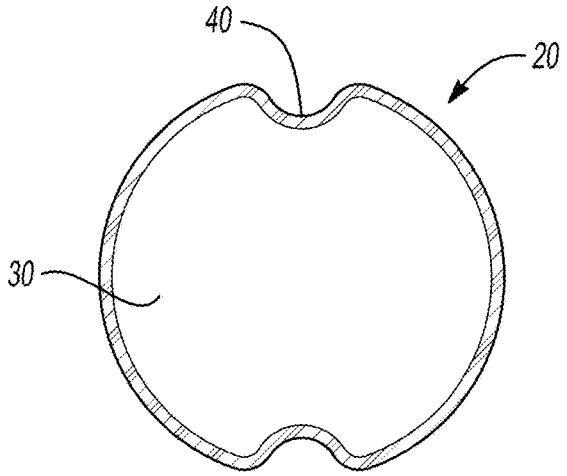
FIG. 4A is a top view of the inner end cap of FIG. 3.
Figure 4B:
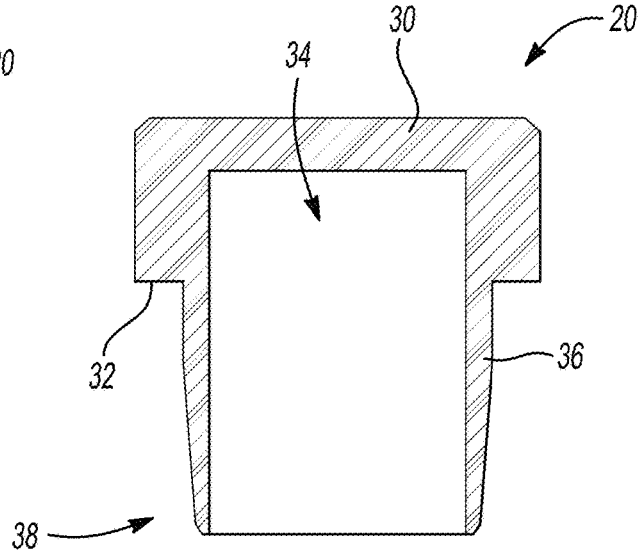
FIG. 4B is a side-view, in cross-section, of the inner end cap of FIG. 3.

Referring to FIGS. 3, 4A, and 4B, the inner cap 20 is made of plastic in this example, and includes a hat 30 that defines a rim 32 extending circumferentially therearound and a cavity 34 therein, and a sleeve 36 extending away from the rim 32 and towards the body 12. The sleeve 36 includes a tapered end 38 to better promote separation of the compressible covering 18 from the flexible bar 16 as the sleeve 36 is being inserted into an end of the body 12 and over the flexible bar 16 such that an end of the flexible bar 16 is contained within the cavity 34 and the rim 32 rests against the edge 26.

The hat 30 has dimples 40 on opposite outer sides thereof. The dimples 40 provide features to grasp during assembly of the inner cap 20 with the body 12. They, however, do not extend into to the cavity 34 in this example. That is, the cavity 34 is generally cylindrical.

The outer cap 22 is also made of plastic in this example, and includes a top 42 and a tube portion 44 extending away from the top 42 and towards the body 12. The top 42 and tube portion 44 define a cavity therein. An end of the flexible bar 16, the ledge 24, and the inner cap 20 are disposed within the cavity such that the hat 30 and top 42 are in contact with each other, and the inner cap 20 is surrounded by the tube portion 44. The tube portion 44 is further sized to be inserted over the hat 30 and ledge 24 such that the tube portion 44 engages the ledge 24 and rests against the lip 28.

The sleeve 36 and tube portion 44 are thus concentrically disposed on opposite sides of that portion of the compressible material 18 that forms the ledge 24. And because the sleeve 36 displaces the compressible material 18 that forms the ledge 24 away from the flexible bar 16 and towards the tube portion 44, the compressible material 18 that forms the ledge 24 is thus compressed between the sleeve 36 and tube portion 44. This improves retention of the inner and outer caps 20, 22 with the body 12, particularly in instances in which the hat 30 is bonded (e.g., adhered) with the top 42.

Figure 5C:
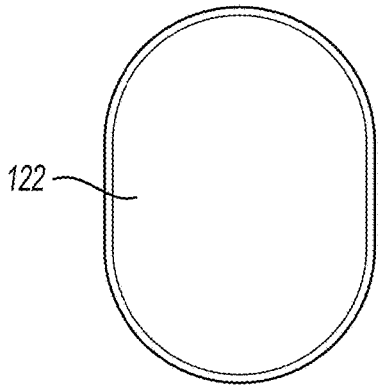
FIG. 5C is an end view of the wrappable sport weight of FIG. 5A.
Figure 5A:
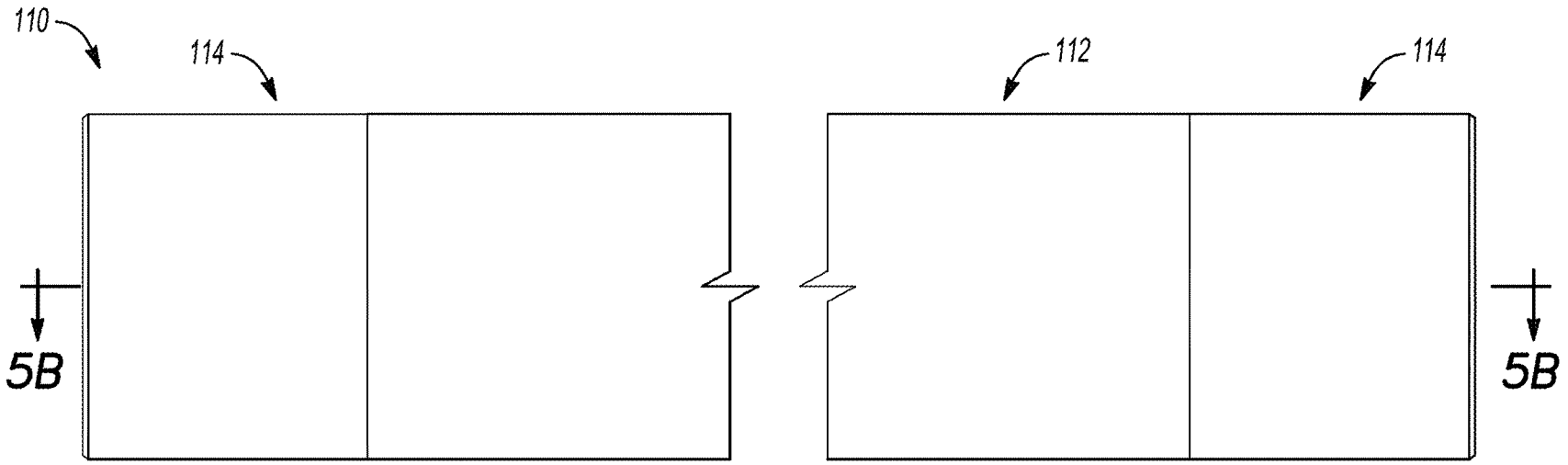
FIG. 5A is a top view of a wrappable sport weight.
Figure 5B:
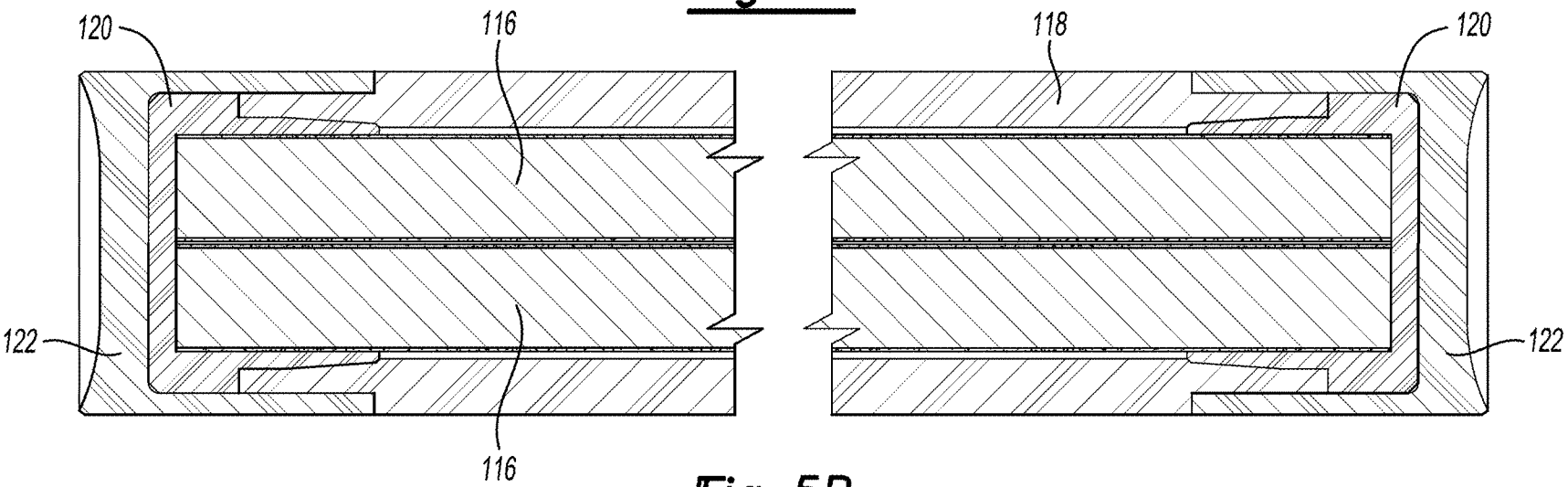
FIG. 5B is a top view, in cross-section, of the wrappable sport weight of FIG. 5A.

Referring to FIGS. 5A, 5B, and 5C, a wrappable sport weight 110 includes a body 112 and a pair of end cap arrangements 114. The body 112 includes a pair of flexible bars 116 (e.g., coated lead bars) and a compressible covering 118 (e.g., a foam covering) surrounding the flexible bars 116. As such, the body 112 may be wrapped around an appendage or sporting equipment while repetitive movements are performed. The end cap arrangements 114 each include an inner cap 120 and an outer cap 122. As discussed in more detail below, the inner cap 120 is nested within the outer cap 122.

Figure 6:
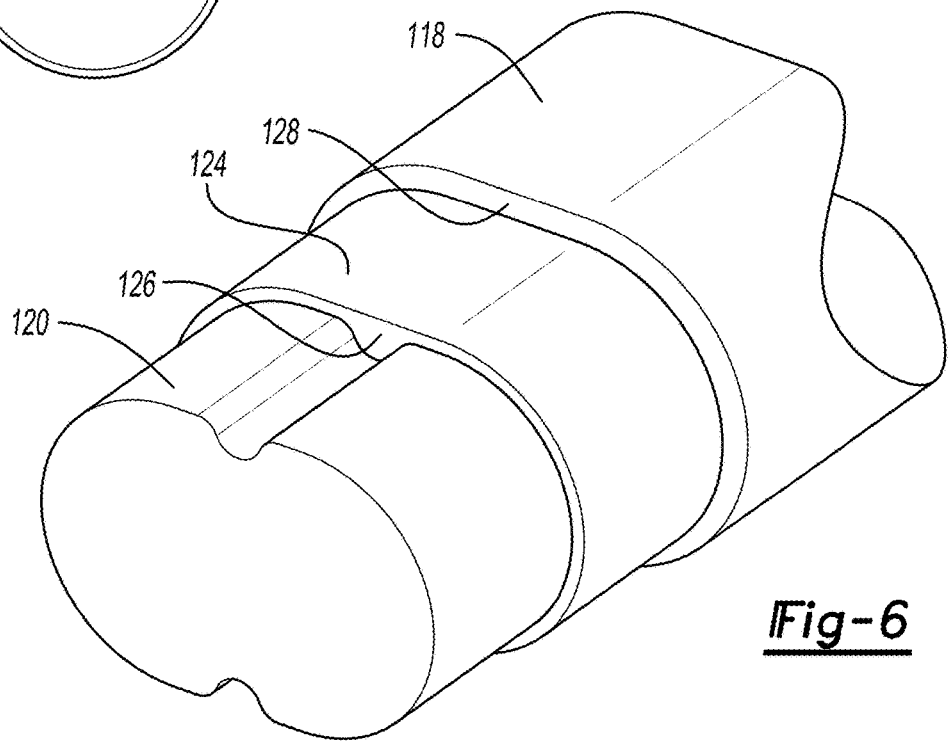
FIG. 6 is a perspective view of an end of the wrappable sport weight of FIG. 5A absent its outer end cap.

Referring to FIG. 6, the compressible covering 118, near ends of the body 112, has a thinner region that defines a ledge 124 with an edge 126 and a lip 128. The edge 126 defines the end of the compressible covering 118 and the lip 128 defines that region between the thicker portion of the compressible covering 118 and the ledge 124 (i.e., the thinner portion of the compressible covering 118). As discussed in more detail below, the outer cap 122 slides over the ledge 124 and rests against the lip 128.

Figure 7:
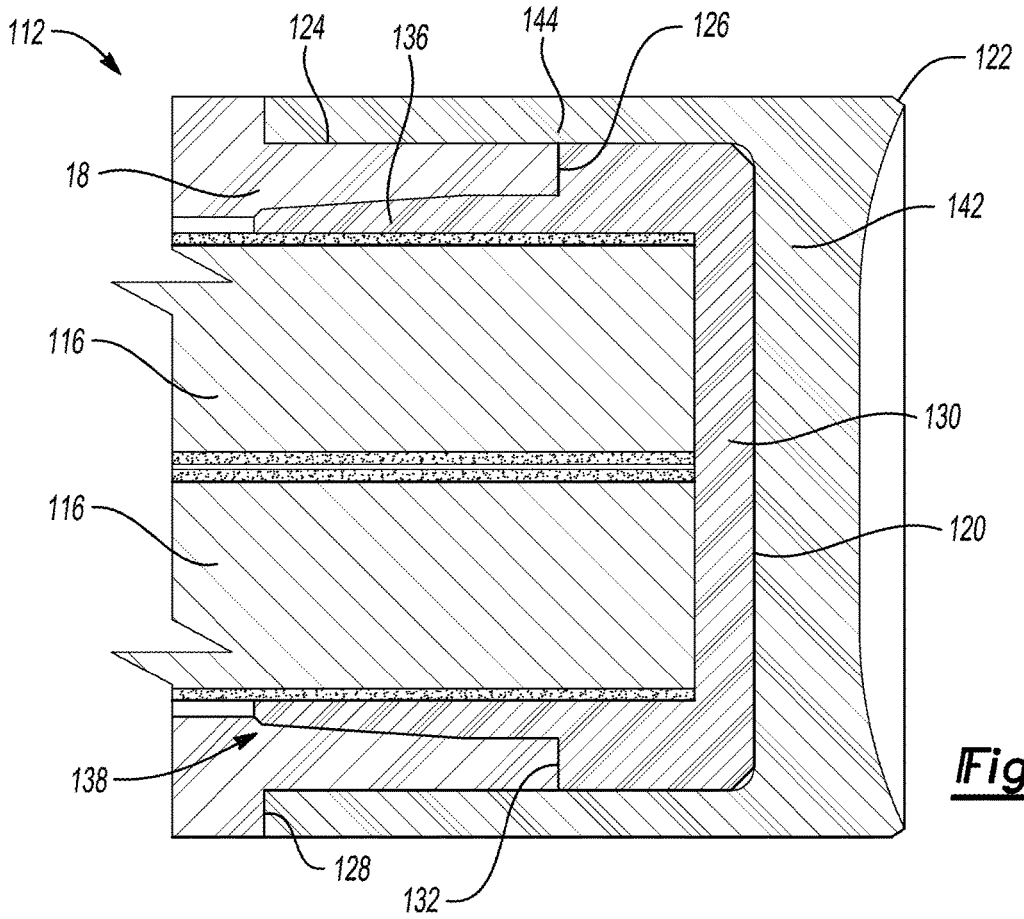
FIG. 7 is a top view, in cross-section, of an end of the wrappable sport weight of FIG. 5B.
Figure 8A:
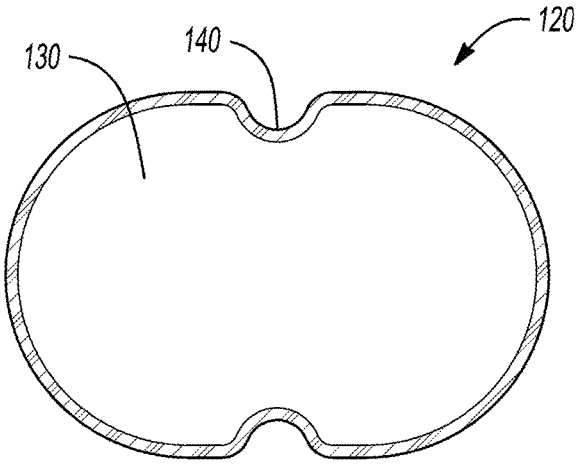
FIG. 8A is a top view of the inner end cap of FIG. 7.
Figure 8B:
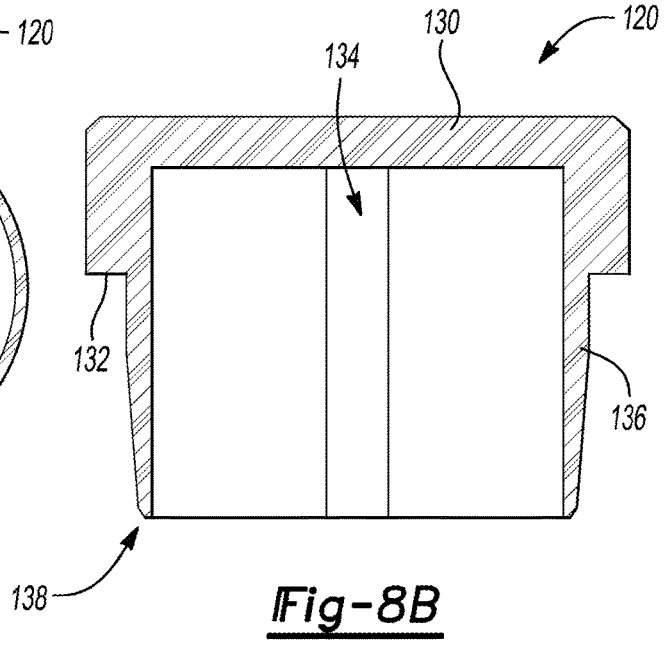
FIG. 8B is a side-view, in cross-section of the inner end cap of FIG. 7.

Referring to FIGS. 7, 8A, and 8B, the inner cap 120 is made of plastic in this example, and includes a hat 130 that defines a rim 132 extending circumferentially therearound and a binocular-shaped cavity 134 therein, and a sleeve 136 extending away from the rim 132 and towards the body 112. The sleeve 136 includes a tapered end 138 to better promote separation of the compressible covering 118 from the flexible bar 116 as the sleeve 136 is being inserted into an end of the body 112 and over the flexible bar 116 such that an end of the flexible bar 116 is contained within the cavity 134 and the rim 132 rests against the edge 126.

The hat 130 has dimples 140 (a type of protrusion) on opposite outer sides thereof. The dimples 140 provide features to grasp during assembly of the inner cap 120 with the body 112. They also extend into to the cavity 134 in this example, which contributes to the binocular-shape mentioned above.

The outer cap 122 is also made of plastic in this example, and includes a top 142 and a tube portion 144 extending away from the top 142 and towards the body 112. The top 142 and tube portion 144 define a cavity therein. Ends of the flexible bars 116, the ledge 124, and the inner cap 120 are disposed within the cavity such that the hat 130 and top 142 are in contact with each other, and the inner cap 120 is surrounded by the tube portion 144. The tube portion 144 is further sized to be inserted over the hat 130 and ledge 124 such that the tube portion 144 engages the ledge 124 and rests against the lip 128.

The sleeve 136 and tube portion 144 are thus concentrically disposed on opposite sides of that portion of the compressible material 118 that forms the ledge 124. And because the sleeve 136 displaces the compressible material 118 that forms the ledge 124 away from the flexible bars 116 and towards the tube portion 144, the compressible material 118 that forms the ledge 124 is thus compressed between the sleeve 136 and tube portion 144. This improves retention of the inner and outer caps 120, 122 with the body 112, particularly in instances in which the hat 130 is bonded with the top 142.

While exemplary embodiments are described above, it is not intended that these embodiments describe all possible forms encompassed by the claims. The words used in the specification are words of description rather than limitation, and it is understood that various changes may be made without departing from the spirit and scope of the disclosure.

As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to strength, durability, life cycle, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A wrappable sport weight system comprising:

a wrappable sport weight including a flexible bar and a compressible covering;

an inner cap including a hat defining a rim configured to rest on an end of the compressible covering, and a sleeve extending away from the rim and configured to be inserted between the compressible covering and the flexible bar to displace a portion of the compressible covering away from the flexible bar, the inner cap defining an inner cavity configured to receive an end of the flexible bar; and an outer cap defining an outer cavity, the inner cap being disposed within the outer cavity such that the hat is surrounded by and in contact with the outer cap, and the outer cap including a tube portion configured to engage a ledge of the wrappable sport weight partially defined by the end such that the portion of the compressible covering is compressed between the sleeve and tube portion.

2. The system of claim 1, wherein the sleeve tapers from the rim to an end thereof.

3. The system of claim 1, wherein the hat and outer cap are bonded to each other.

4. The system of claim 1, wherein the inner cavity is further configured to receive an end of an additional flexible bar.

5. The system of claim 4, wherein the inner cavity has a binocular shape.

6. The system of claim 4, wherein an interior surface of the sleeve defines a pair of opposing protrusions extending into the inner cavity and configured to space the flexible bar away from the additional flexible bar.

7. The system of claim 1, wherein the inner cavity has a cylindrical shape.

8. A wrappable sport weight system comprising:

a wrappable sport weight including a pair of flexible bars and a compressible covering;

an inner cap including a hat defining a rim configured to rest on an end of the compressible covering, and a sleeve extending away from the rim and configured to be inserted between the compressible covering and the pair of flexible bars to displace a portion of the compressible covering away from the flexible bars, the inner cap defining a binocular-shaped inner cavity configured to receive ends of the flexible bars; and an outer cap defining an outer cavity, the inner cap being disposed within the outer cavity such that the hat is surrounded by and in contact with the outer cap, and the outer cap including a tube portion configured to engage a ledge of the wrappable sport weight partially defined by the end such that the portion of the compressible covering is compressed between the sleeve and tube portion.

9. The system of claim 8, wherein the sleeve tapers from the rim to an end thereof.

10. The system of claim 8, wherein the hat and outer cap are bonded to each other.

11. The system of claim 8, wherein an interior surface of the sleeve defines a pair of opposing protrusions extending into the inner cavity and configured to space the flexible bars away from each other.

* * * * *